US007973758B2

(12) United States Patent
Lo

(10) Patent No.: US 7,973,758 B2
(45) Date of Patent: Jul. 5, 2011

(54) APPARATUS AND METHOD FOR CONTROLLING DISPLAY BACKLIGHT ACCORDING TO STATISTIC CHARACTERISTIC OF PIXEL COLOR VALUES

(75) Inventor: Jui-Lin Lo, Tainan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 878 days.

(21) Appl. No.: 11/530,026

(22) Filed: Sep. 8, 2006

(65) Prior Publication Data

US 2007/0216636 A1 Sep. 20, 2007

(30) Foreign Application Priority Data

Mar. 16, 2006 (TW) ..... 95108950 A

(51) Int. Cl.
*G09G 3/36* (2006.01)

(52) U.S. Cl. ..... 345/102

(58) Field of Classification Search ..... 345/501, 345/589, 87–104, 211–213
See application file for complete search history.

(56) References Cited

U.S. PATENT DOCUMENTS 6,795,053 B1 * 9/2004 Funamoto et al. ..... 345/102
6,862,012 B1 * 3/2005 Funakoshi et al. ..... 345/88
2002/0041280 A1 * 4/2002 Woo ..... 345/212
2003/0222884 A1 * 12/2003 Ikeda et al. ..... 345/589
2004/0104877 A1 * 6/2004 Kitagawa ..... 345/88
2004/0155854 A1 * 8/2004 Ma et al. ..... 345/102
2005/0248524 A1 * 11/2005 Feng et al. ..... 345/102
2006/0146003 A1 * 7/2006 Diefenbaugh et al. ..... 345/102
2006/0146056 A1 * 7/2006 Wyatt ..... 345/501
2006/0209005 A1 * 9/2006 Pedram et al. ..... 345/102
2007/0152949 A1 * 7/2007 Sakai ..... 345/102
2008/0094346 A1 * 4/2008 De Greef ..... 345/102

FOREIGN PATENT DOCUMENTS

WO WO2005050614 * 6/2005
WO WO 2005109391 A1 * 11/2005

* cited by examiner

*Primary Examiner* — Chanh Nguyen
*Assistant Examiner* — Sanghyuk Park
(74) *Attorney, Agent, or Firm* — Jianq Chyun IP Office

(57) ABSTRACT

An apparatus and method for display backlight control are disclosed. The method includes: finding statistics characteristics of pixels in a frame; using statistics characteristics to refer to a table for outputting representative gamma value; using a user setting value and representative gamma value for calculating a backlight setting range; starting from the user setting value, using a backlight adjusting value obtained from subtracting or adding a predetermined value from current backlight setting value to control a backlight module in each predetermined time period; using boundary value of the current backlight setting range as backlight adjusting value when the backlight adjusting value is beyond the backlight setting range; using current backlight adjusting value and user setting value to refer to an image compensation table for finding an image compensation value; performing compensation operations on input image data according to the backlight adjusting value and the user setting value of backlight luminance.

22 Claims, 4 Drawing Sheets

APPARATUS AND METHOD FOR CONTROLLING DISPLAY BACKLIGHT ACCORDING TO STATISTIC CHARACTERISTIC OF PIXEL COLOR VALUES

CROSS-REFERENCE TO RELATED APPLICATION

This application claims the priority benefit of Taiwan application serial no. 95108950, filed on Mar. 16, 2006. All disclosure of the Taiwan application is incorporated herein by reference.

BACKGROUND OF THE INVENTION

1. Field of Invention

The present invention relates to an apparatus and a method for controlling a display backlight, and more particularly to an apparatus and a method for adjusting backlight intensity according to image data of a transmittive display.

2. Description of the Related Art

In the total power consumption of a display, the backlight thereof takes the most share. In terms of a conventional transmittive display (an LCD or an LCD projector, for example), the backlight intensity thereof is usually unchanged regardless of a bright image frame or a darker image frame the display gives, wherein an optical gate (the liquid crystal cell) is adjusted to decay the excessive light or to allow more portion of light passing through according to the different brightness or color of a specific pixel. In order to save power or increase contrast, an idea by adjusting the backlight intensity to achieve these goals in response to different color or brightness of a frame was emerged. In the following paragraphs, a transmittive LCD is described as example.

In the total power consumption of an LCD, the backlight thereof takes the most share, which is particularly impressive in the applications of portable products, such as a notebook PC or a personal digital assistant (PDA) where the backlight consumes up to 20~30% of the entire power. With a transmittive LCD, a user can adjust backlight intensity thereof to fit a user's preference and ambient brightness; however, the backlight intensity, i.e. the power consumption, is the same, even for a darker frame. For a pixel thereof to get darker, a driving circuit is used to rotate the liquid crystal molecules of the LCD for decaying the excessive light. On the other hand, an alternative measure for saving power is that for the darker displayed frame, the backlight intensity is reduced in associate with increasing color values of the display pixels accordingly (i.e. to allow more portion of light to pass through). With such a novel method, the power is reduced while maintaining the original luminance and contrast. Furthermore, this method is easy to extended to include contrast enhancement and color adjustment capabilities.

To offer the power-saving capability, an apparatus for dynamically adjusting backlight of an LCD panel was provided. FIG. 1 is a block diagram showing a conventional apparatus for dynamically adjusting backlight of a LCD panel. Referring to FIG. 1, the apparatus comprises an image analyzer 100, an image compensator 102, a backlight controller 104 and a pulse width adjustor (PW adjustor) 106. By using the apparatus, all pixel signals of a frame are input to the image analyzer 100 to find out the maximum pixel color value of the frame. As an example, it is assumed that the maximum color value of all the pixels is [200] and the upper limit of the color value is [255] corresponding to an 8-bit display. The image compensator 102 respectively multiplies all pixel color values C by a factor S to obtain updated pixel color values C', C'=C*S, wherein the factor S is the quotient of the upper limit of the color values by the maximum color value of all the pixels in a frame; thus, S=255/200 herein. In addition, the backlight controller 104 divides the original backlight luminance L by the factor S (i.e. 255/200 herein) to obtain an updated backlight luminance L' (L'=L/S), followed by sending L' to the PW adjustor 106 for obtaining a reduced backlight luminance of L'=L/S.

By using the mentioned scheme, all color values of all pixels are magnified by a factor and the backlight is adjusted to be darker by the same factor. If the relationship of color value vs. brightness and the relationship of backlight vs. intensity are ideally proportional (i.e. Y=CX), the scheme would be applicable to achieve power-saving without affecting the display quality. In fact, however, the relationship between color values of RGB pixels (red, green and blue pixels) and brightness and the relationship between backlight and intensity are not proportional. That is, the corresponding to a color value [100] is not double of the brightness corresponding to a color value [50]. People who skilled in the art knows, the relationship between brightness and color value is a so-called Gamma function of a display, which is a nonlinear function. Therefore, during an adjustment process, the brightness and the color of a frame would be dramatically changing resulting in undesired and poor image quality, and such degradation is unacceptable by users.

SUMMARY OF THE INVENTION

An objective of the present invention is to provide an apparatus and a method for adjusting a backlight and correspondingly compensating display colors suitable for a transmittive display. By using the provided apparatus and method, the backlight module is controlled on the basis of the statistics of the brightness and color values of pixels for power-saving and maintaining good frame quality.

The present invention provides an apparatus for controlling display backlight, which includes an image analyzer, a look-up table of color value and its corresponding brightness, a calculator of backlight setting value, a backlight adjustor, an image compensator and a multiplier. The image analyzer receives image data and finds out the statistic characteristic of the image data. The look-up table of color value and its corresponding brightness receives the above-mentioned statistic characteristic and outputs the corresponding representative Gamma value according to the statistic characteristic. The calculator of backlight setting value receives a user setting value of backlight and the representative Gamma value and then calculates a setting range of backlight. The backlight adjustor receives the setting range of backlight and the user setting value of backlight and then, starts from the user setting value of backlight, subtracts a predetermined value from the present backlight adjustment value to serve as an output updated backlight adjustment value to control the backlight module and in every predetermined time. When the backlight adjustment value exceeds the range of backlight setting value, the upper limit or the lower limit of the range of backlight setting value is taken as the updated backlight adjustment value. The image compensator receives the backlight adjustment value, the user setting value of backlight brightness and the input image data and outputs a compensated image.

The present invention provides a method for controlling display backlight, which includes the following steps. First, the image data is received, followed by finding out the statistic characteristic of the image data. Next, a look-up table of color value and its corresponding brightness is provided. The representative Gamma value corresponding to the above-mentioned statistic characteristic is output. Afterwards, a setting range of backlight is calculated according to the user setting value of backlight brightness and the representative Gamma value. Then, starting from the user setting value of backlight brightness, the present backlight adjustment value is subtracted by a predetermined value to serve as an updated backlight adjustment value for output in every predetermined time. When the backlight adjustment value exceeds the range of backlight setting value, the upper limit or the lower limit of the range of backlight setting value is taken as the updated backlight adjustment value. Further, a compensation operation on the input image data is performed according to the updated backlight adjustment value and the user setting value of backlight brightness.

The present invention is featured by creating a look-up table of color value and its corresponding brightness, a look-up table of setting value of backlight and its corresponding brightness and an image compensation table, a more convenient and more effective way to find out the corresponding pixel brightness from a pixel color value and to find out the setting value of backlight from the brightness is feasible, which prevents complicated nonlinear calculations. Furthermore, by using an image compensation table, the nonlinear relationships are compensated. In this way, the present invention is able to minimize the undesirable variation of brightness and color during the process for adjusting the backlight brightness. Therefore, the present invention is effective to save power with imperceptible image change, which prevents degradation in display image quality by noticeable brightness and color changes resulted from by the prior art.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

To solve the display quality degradation problem caused by the conventional apparatus for controlling display backlight to achieve power saving purpose, the present invention provides an apparatus and a method for controlling display backlight and compensating display colors. Different from the simple linear processing used in the prior art, the present invention adopts a nonlinear method to solve the image quality degradation problem of brightness and color changes during adjusting display backlight in order to save power. The steps of the method and the apparatus provided by the embodiment of the present invention are explained in detail as follows.

Figure 1:
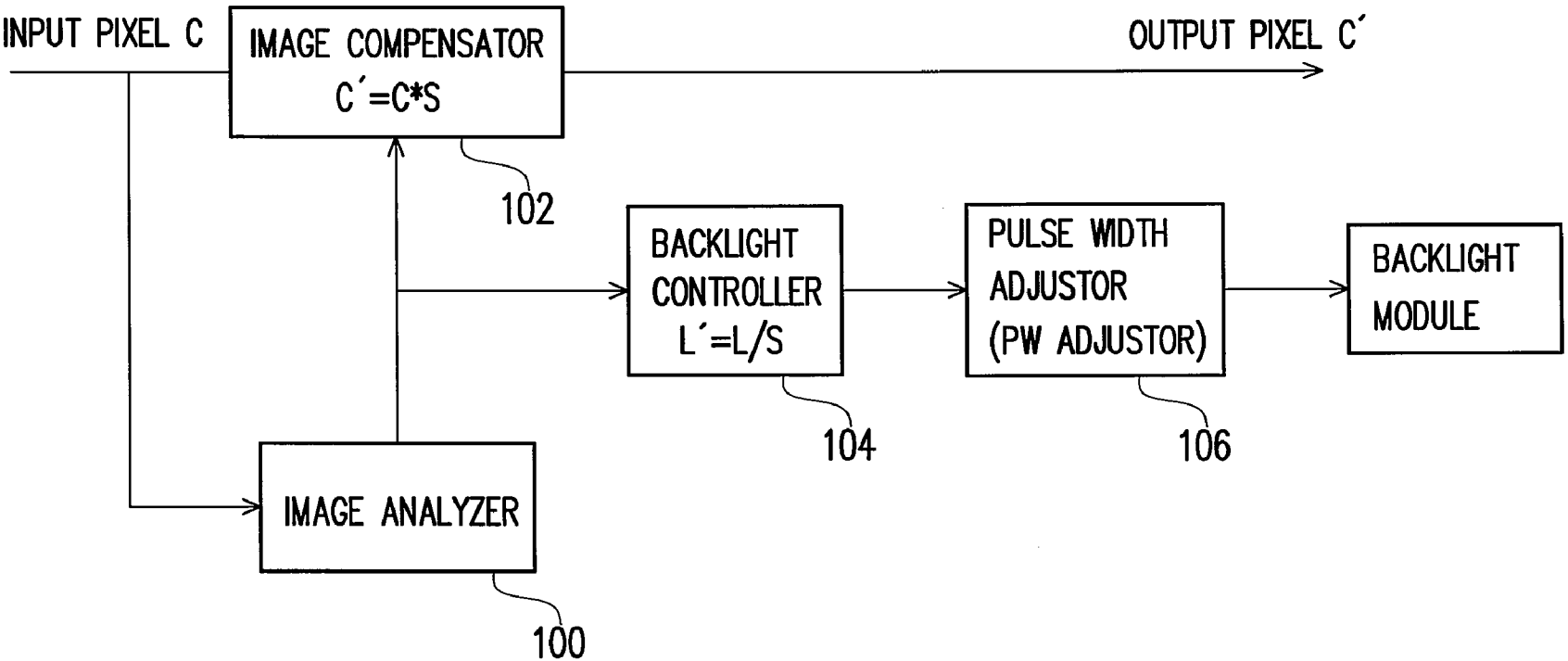
FIG. 1 (PRIOR ART)
FIG. 1 is a block diagram showing a conventional apparatus for dynamically adjustment backlight of a LCD panel.
Figure 2:
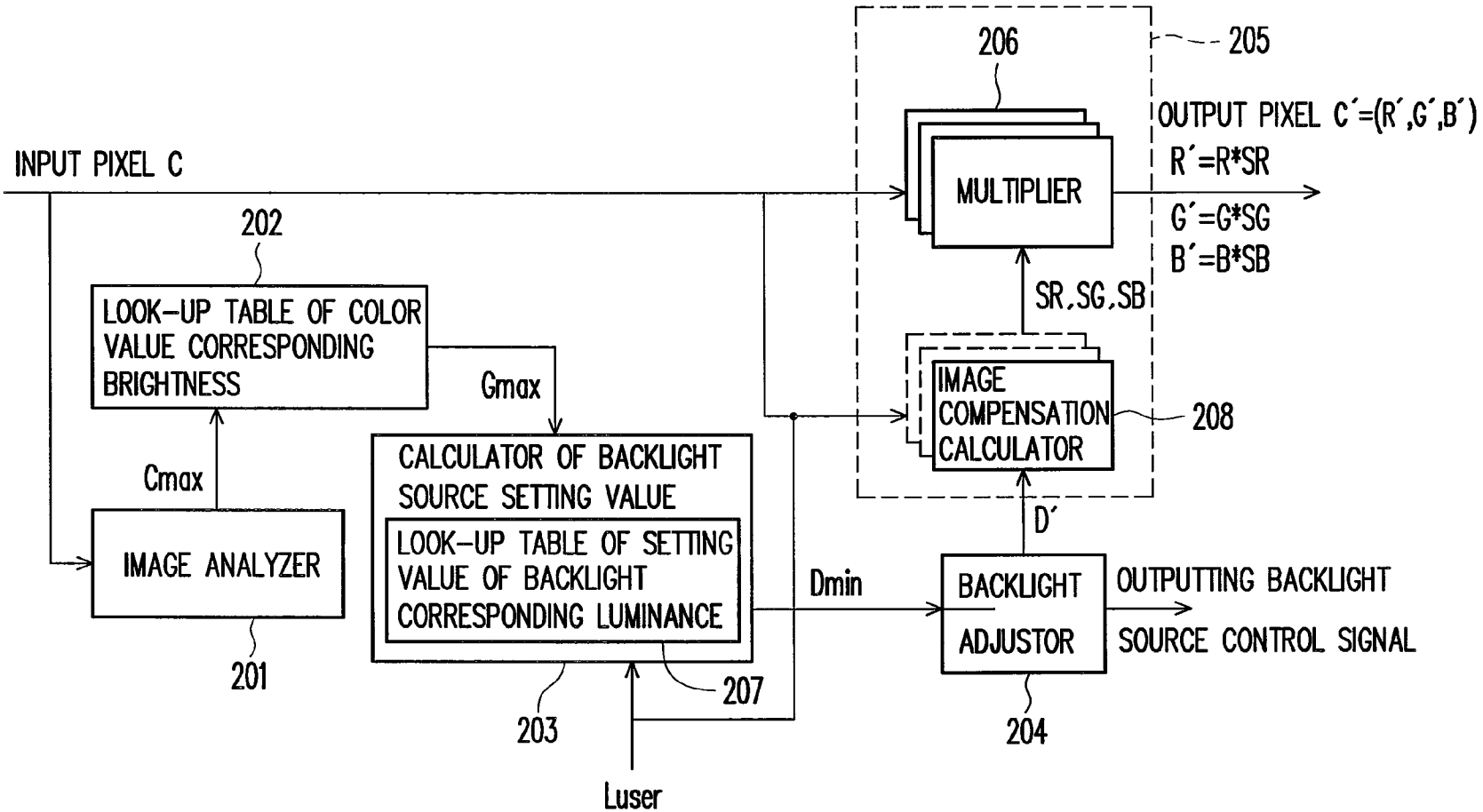
FIG. 2 is a block diagram showing a backlight adjustment apparatus circuit of a display according to an embodiment of the present invention.

FIG. 2 is a block diagram showing a backlight adjustment apparatus of a display according to an embodiment of the present invention. Referring to FIG. 2, the apparatus herein comprises an image analyzer 201, a look-up table of color value and its corresponding brightness 202, a calculator of backlight setting value 203, a backlight adjustor 204 and an image compensator 205, wherein the calculator of backlight setting value 203 includes a look-up table of setting value of backlight and its corresponding intensity 207 and the image compensator 205 includes a multiplier 206 and an image compensation calculator 208.

Figure 3:
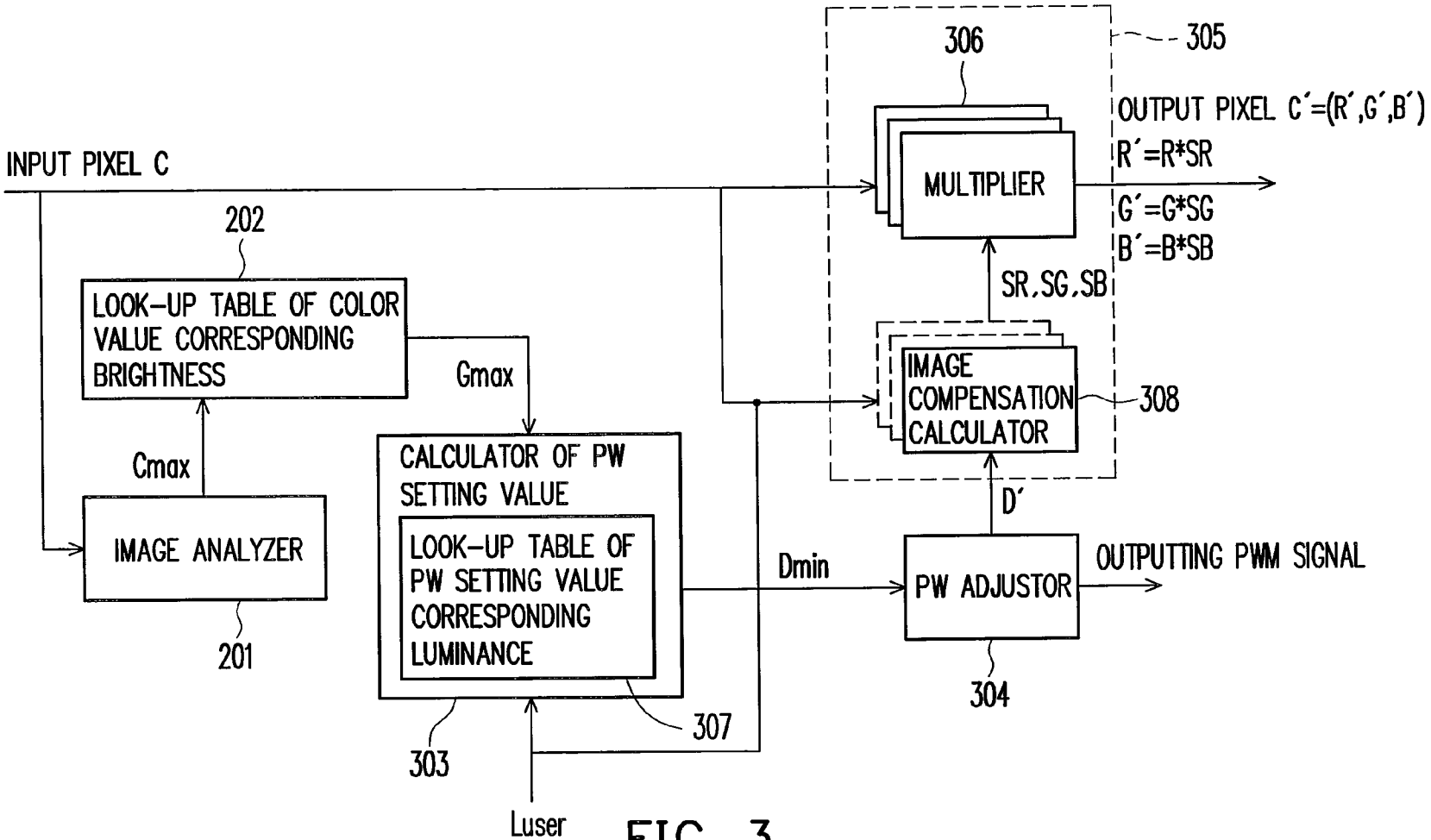
FIG. 3 is a block diagram showing a backlight adjustment apparatus circuit of a transmittive LCD according to an embodiment of the present invention.

For conveniences a most familiar LCD is taken as exemplary for explanation. The backlight of the LCD can be a cold cathode fluorescent lamp (CCFL) and the luminance thereof is controlled by pulse width modulation (PWM), where the longer the output high-level voltage occupies during its period, the brighter the backlight's output intensity is. The circuit block diagram corresponding to the PWM implement is shown in FIG. 3. Referring to FIG. 3, a backlight adjustment apparatus includes an image analyzer 301, a look-up table of color value and its corresponding brightness 302, a pulse width (PW) calculator 303, a PW adjustor 304 and an image compensator 305, wherein the PW calculator 303 comprises a look-up table of PW setting value and its corresponding backlight output intensity 307 and the image compensator 305 comprises a multiplier 306 and an image compensation calculator 308. By a comparison between FIG. 2 and FIG. 3 it can be seen that the calculator of backlight setting value 203 is implemented by the PW calculator 303 in FIG. 3, the backlight adjustor 204 is implemented by the PW adjustor 304 in FIG. 3 and the look-up table of setting value of backlight and its corresponding intensity 207 is implemented by the look-up table PW setting value and its corresponding intensity 307 in FIG. 3.

For convenience to explain the spirit of the present invention, some assumptions are made in the followings paragraphs. But the scope of the invention will not limited by these assumption. Assuming a color value of each of three primary colors RGB (representing red, green and blue primary colors) is represented by an 8-bit binary number, thus, the range of the color values is between 0 and 255 of decimal number. The method provided by the present invention is also able to be directly applied in other color spaces or an input of monochromatic color image, where the color space can be converted into an RGB space, or the primary colors comprising the color space can be individually processed.

The image analyzer 301 is for receiving the color values of all pixels in an entire frame and to calculate some statistics values such as the maximum color value Cmax of the frame, for example, [200]. The maximum color value Cmax is the maximum value of all the color sub-pixels (for example, R G and B subpixels) in a frame. After that, the look-up table of color value and its corresponding brightness 302 receives the maximum color value Cmax and outputs the corresponding brightness value corresponding to the Cmax [200]. The relationship of color value vs. brightness is often a highly nonlinear function. For example, assuming a color value of [255] and its corresponding brightness (Gamma value) is normalized to be 1, the color value of [128] usually does not correspond a Gamma value of 0.5, and it could be 0.41, which is subjective to the Gamma function of the display. Therefore, the look-up table of color value and its corresponding brightness 302 is used to find out the corresponding brightness. By using the look-up table of color value and its corresponding brightness 302, it is assumed the maximum brightness corresponding to the maximum color value Cmax [200] is 0.7 herein, which is defined as the representative Gamma value Gmax.

The calculator of PW setting 303 receives a user setting value of backlight intensity (Iuser) and the representative Gamma value Gmax of a frame. In general, a system maker or a user would specify the user setting value of backlight intensity (Iuser) to meet the user's preference and the ambient brightness for its application environment. Wherein, it is assumed the setting range of backlight intensity is between [0]~[255] represented by 8-bit numbers and the user setting value of backlight intensity (Iuser) is specified as 80% of the backlight maximum intensity. It is assumed the calculated maximum brightness of the brightest pixel in the frame is 0.8×0.7=0.56 according to the Gamma value 0.7, followed by inputting the maximum brightness 0.56 to the look-up table of PW setting value and its corresponding intensity 307 to find out the corresponding minimum pulse width value (minimum PW value) Dmin, for example, [130]; in addition, a computation circuit for mapping setting value and intensity can be used to replace the look-up table of PW setting value and its corresponding intensity 307. A simplified polynomial can be used to calculate $Y=K*(X)^{\gamma}$, for example, a quadratic polynomial of $Y=A*(X)^2+B*(X)+C$ is used to approximate $Y=K*(X)^{\gamma}$ for calculating the minimum PW value Dmin.

The PW adjustor 304 receives the minimum PW value Dmin [130] and the user setting value of backlight intensity Iuser [204]. Start from the user setting value of backlight intensity, the PW value is step-by-step adjusted towards the minimum PW value and takes Dmin as the lower limit of the adjustment process. During gradually decreasing the PW value, an output pulse width modulation signal is generated to control the intensity of the backlight module in response to an updated PW value D'. Since the response time from PWM adjusting command for backlight to reach its final output luminance takes from 10 ms to 0.4 s, thus, a better scheme is to change PW value gradually. Otherwise, a noticeable variation of color and brightness would appear if the PW value of backlight is adjusted to Dmin directly.

Accordingly, in the embodiment of the present invention, the adjustment process is conducted in every predetermined time. For example, in every vertical blanking interval (VBI) and initially starting from the user setting value of backlight, a present PW adjustment value is subtracted by a predetermined value (for example, 5), followed by outputting it as an updated PW value D'. In this way, the PW adjustment value of the next frame would be [204]−[5]=[199], wherein [204] corresponds the user setting value of backlight intensity Iuser=80%, i.e. [255]×80%=[204]. Further, the PW value D' of the third frame would be [199]−[5]=[194]. Step by step, the adjustment process is conducted until the updated PW value D' is smaller than or equal to the minimum PW value Dmin=[130], which is considered as the final PW value according to the previous frame statistics. The minimum PW value Dmin is the boundary value of the range for adjustment, and the adjustment process is repeated until the updated PW value D' reaches the boundary value of the range. The backlight adjusting method can be extended as the following to keep tracking of the image content statistics: If in a certain image frame the current PWM setting is less than the Dmin because of image content changes, the adjustment direction is inverted. Instead of subtracting a predetermined value from the previous current PW setting, the PW setting is increased by a predetermined value.

The image compensation calculator 308 receives a PW adjustment value, finds out an image compensation value of each primary color. This task can be done by referring to an image compensation table according to the PW adjustment value and the pixel color values and outputs the image compensation value. After that, the multiplier 306 receives the image compensation values of all the primary colors (Sr, Sg, Sb) and the pixel color values, respectively multiplies the pixel color values by Sr, Sg and Sb and outputs the compensated pixel color values, which can be expressed by the following equations:

$$R'=R*Sr,\ G'=G*Sg,\ B'=B*Sb.$$

The compensated pixel color values are output to the driver ICs to drive the display panel. As the above described, the duty cycle of a pulse width modulation signal is adjusted step by step, thereof, the corresponding grayscales are accordingly adjusted gradually to maintain the consistency of pixel brightness or pixel color. If the statistic characteristic of input frames are changed, the above-described calculations and adjustments process will start all over again. The initial PWM value can be user setting of backlight or PWM current value.

Figure 4:
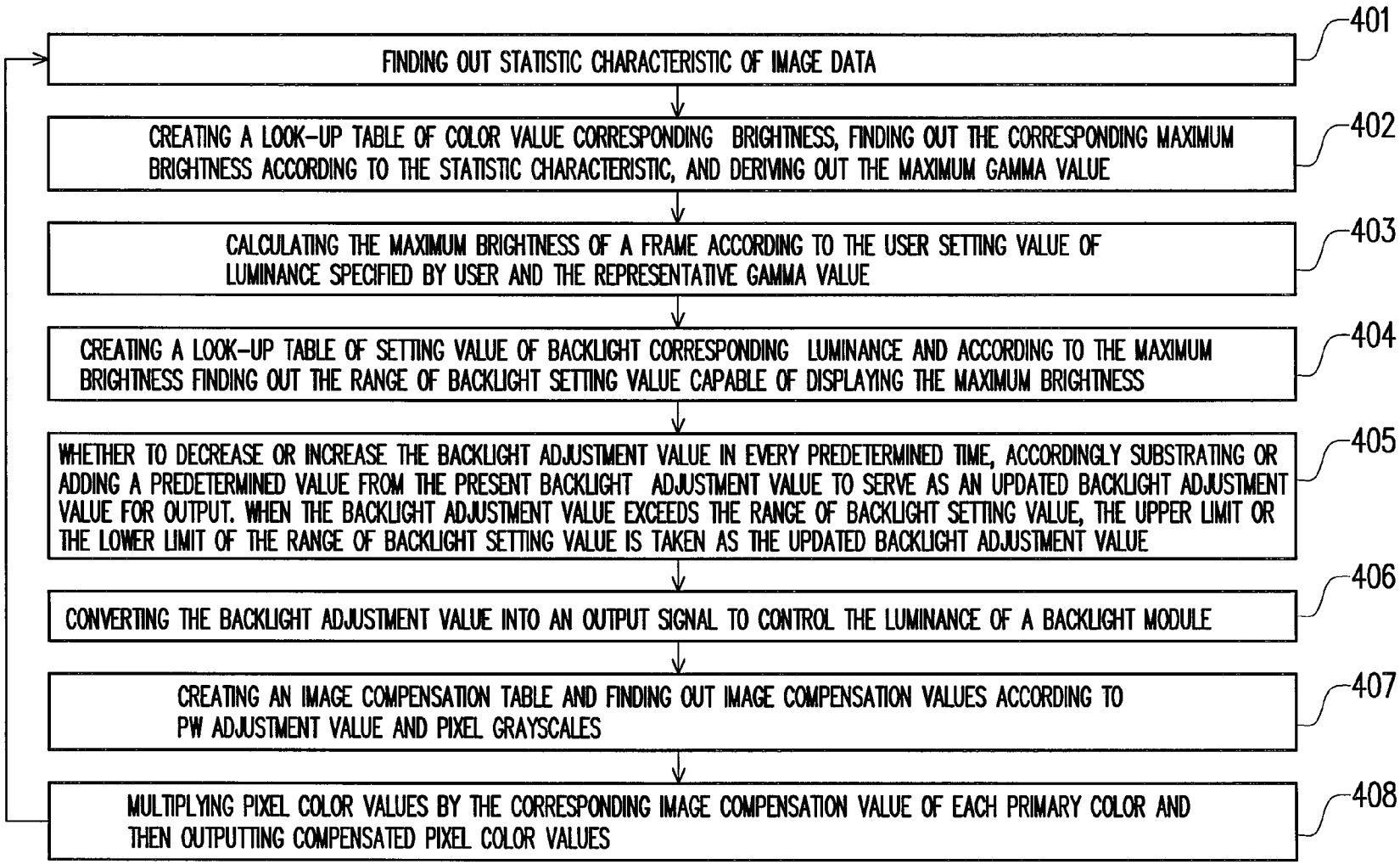
FIG. 4 is a flowchart of a method for controlling an LCD backlight according to an embodiment of the present invention.

From the above-described apparatus of the present embodiment, a method for controlling display backlight and the corresponding color compensation method is demonstrated. FIG. 4 is a flowchart of a method for controlling an LCD backlight and the corresponding color compensation method according to an embodiment of the present invention. Referring to FIG. 2 and FIG. 4, the method includes the following steps. First, an image analyzer 201 is used to find out the statistic characteristic of the image data (for example, the frame of the above-described embodiment or multiple sub-frames of the frame), such as the maximum color values of the image data as described hereinbefore (step 401). Next, a look-up table of color value and its corresponding brightness 202 is created and the corresponding brightness according to the statistic characteristic, i.e. the representative Gamma value, is found out (step 402).

Afterwards, a calculator of backlight setting value 203 is used to calculate the maximum brightness of a frame according to the setting value of brightness specified by user and the representative Gamma value (step 403). Then, a look-up table of setting value of backlight and its corresponding intensity is created, and the range of backlight setting value capable of displaying the maximum brightness is determined according to the maximum brightness (step 404). Further, a backlight adjustor 204 is used and, initially starting from the user setting value of backlight intensity, in every predetermined time, the present backlight adjustment value is subtracted by a predetermined value to serve as an updated backlight adjustment value to output for the purpose of reducing the backlight intensity. When the backlight adjustment value exceeds the range of backlight setting value, the upper limit or the lower limit of the range of backlight setting value is taken as the updated backlight adjustment value (step 405). That is, the boundary value of the backlight setting value is used as the updated backlight adjustment value. Furthermore, a backlight adjustor 204 is used to convert the backlight adjustment value into an output signal to control the intensity of a backlight module (step 406). After that, an image compensation table is created and an image compensator 205 is used to find out image compensation values according to PW adjustment value and pixel grayscales (step 407). Finally, a multiplier 206 is used to multiply the pixel color values by the corresponding image compensation value of each primary color, respectively, and outputting the compensated pixel color values (step 408).

In summary, the present invention is based on a framework including a look-up table of color value and its corresponding brightness, a look-up table of setting value of backlight and its corresponding intensity and an image compensation table, and further, by using the above-mentioned look-up tables, the nonlinear relationships of color value vs. brightness, setting value of backlight vs. intensity are easily handled. In addition, by compensating the nonlinear relationships with the image compensation table, it is capable of reducing the noticeable variations of brightness and color during the adjustment process of reducing the backlight intensity. Therefore, the present invention is superior not only in saving energy, but also in producing image variations negligible for viewers, which provides a solution to the display image quality degradation of variations of brightness and color caused by the prior art.

All or some of above look-up tables can be replaced or approximated by other calculation method such as polynominal approximation which can implemented by circuit or software program. This substitution is up to implementer's choice.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. An apparatus for controlling display backlight, comprising:

an image analyzer, for receiving an input image data and finding out a statistic characteristic of the pixel color values of the image data;

a look-up table device of color value and its corresponding brightness, established according to the statistic characteristic, for outputting a Gamma value according to the statistic characteristic;

a calculator, for receiving a user setting value of backlight intensity and the Gamma value and calculating out an appropriate setting range of backlight according to the user setting value of backlight intensity and the Gamma value;

a backlight adjustor for receiving the setting range of backlight and the user setting value of backlight intensity, wherein the backlight adjustor is used, first determine to decrease or increase backlight adjustment value, initially starting from the user setting value of backlight intensity and in a predetermined time, to subtract or add a predetermined value from a present backlight adjustment value accordingly, wherein the resulted value serving as an next backlight adjustment value is output to control a backlight module, and when the backlight adjustment value exceeds a boundary value of the setting range of backlight, the boundary value is used as the backlight adjustment value; and an image compensator, for receiving the backlight adjustment value, the user setting value of backlight intensity and the input image data, in order to output a compensated image data, wherein the image compensator comprises:

an image compensation calculator, for receiving the backlight adjustment value and the user setting value of backlight intensity to output an image compensation value of each primary color by referring to an image compensation table according to the pulse width adjustment value and the pixel color values; and a multiplier, for receiving the image compensation value and all the pixel color values in the image data, multiplying all the pixel color values of the input image data by the image compensation value and outputting the results serving as the compensated pixel color values.

2. The apparatus for controlling display backlight of claim 1, wherein the calculator comprises:

a look-up device of backlight setting value and its corresponding intensity, for determining an upper limit or a lower limit of the backlight setting value capable of displaying the corresponding maximum brightness according to the maximum color value.

3. The apparatus for controlling display backlight of claim 1, wherein the image data are pixels in a frame.

4. The apparatus for controlling display backlight of claim 1, wherein the statistic characteristic comprises the maximum value of all the pixel color values in the image data or the maximum value of all the pixel color values subtracted by a predetermined value.

5. The apparatus for controlling display backlight of claim 1, wherein the statistic characteristic comprises the maximum value of the brightness values corresponding to all the pixel colors in the image data or the maximum value of the brightness values corresponding to all the pixel colors subtracted by a predetermined value.

6. The apparatus for controlling display backlight of claim 1, wherein the backlight comprises a backlight inverter and a cold cathode fluorescent lamp.

7. The apparatus for controlling display backlight of claim 1, wherein the backlight comprises light-emitting diodes and the controller thereof.

8. The apparatus for controlling display backlight of claim 1, wherein the predetermined time is a plurality of vertical blanking intervals.

9. The apparatus for controlling display backlight of claim 1, wherein the predetermined time is a plurality of horizontal blanking intervals.

10. The apparatus for controlling display backlight of claim 1, wherein the image data are pixels in one of the sub-frames obtained by partitioning the frame into a plurality of parts.

11. The apparatus for controlling display backlight of claim 1, wherein the image compensator and the look-up device can be implemented as look-up tables through measuring the characteristics of the display or backlight or to obtain the approximated results by using hardware circuits or appropriate programs.

12. A method for controlling display backlight, comprising:

receiving an input image data and finding out a statistic characteristics of the pixel color values in the input image data;

providing a look-up device of color value and its corresponding brightness, established according to the statistic characteristic, for outputting a corresponding Gamma value according to the statistic characteristic;

calculating out a setting range of backlight according to a user setting value of backlight luminance and the Gamma value;

determining to decrease or increase backlight adjustment value in every predetermined time and initially starting from the user setting value of backlight intensity, subtracting or adding a predetermined value from a present backlight adjustment value accordingly, outputting the resulted value as an next backlight adjustment value to control a backlight module and taking a boundary value of the setting range of backlight as the backlight adjustment value when the backlight adjustment value exceeds the boundary value of the range of backlight setting value; and performing compensation operations on the input image data according to the backlight adjustment value and the user setting value of backlight intensity by following steps:

determining an image compensation value of each primary color by referring to an image compensation table according to the pulse width adjustment value and the pixel color values according to the backlight adjustment value and the user setting value of backlight intensity; and multiplying all the pixel color values of the input image data by the image compensation value and outputting a compensated image data to display the frames.

13. The method for controlling display backlight of claim 12, further comprising:

providing a look-up device of backlight setting value and its corresponding intensity, for finding out an upper boundary or a lower boundary of the backlight setting value capable of displaying the corresponding maximum color value according to the maximum color value.

14. The method for controlling display backlight of claim 12, wherein the statistic characteristic comprises the maximum value of all the pixel color values or the maximum value of all the pixel color values subtracted by a predetermined value.

15. The method for controlling display backlight of claim 12, wherein the statistic characteristic comprises the maximum value of the brightness values corresponding to all the pixel colors or the maximum value of the brightness values corresponding to all the pixel colors subtracted by a predetermined value.

16. The method for controlling display backlight of claim 12, wherein the backlight comprises a backlight inverter and a cold cathode fluorescent lamp.

17. The method for controlling display backlight of claim 12, wherein the backlight comprises light-emitting diodes and the controller thereof.

18. The method for controlling display backlight of claim 12, wherein the predetermined time is a plurality of vertical blanking intervals.

19. The method for controlling display backlight of claim 12, wherein the predetermined time is a plurality of horizontal blanking interval.

20. The method for controlling display backlight of claim 12, wherein the image data is a frame.

21. The method for controlling display backlight of claim 12, wherein the image data is one of the sub-frames obtained by partitioning the frame into a plurality of parts.

22. The method for controlling display backlight of claim 12, wherein the image compensator, the look-up device of color value and its corresponding brightness and the look-up device of backlight setting value and its corresponding intensity can be implemented as look-up tables through measuring the characteristics of the display or backlight or to obtain the approximate results by using hardware circuits or appropriate programs.

* * * * *